US006626371B1

(12) United States Patent
Boecking

(10) Patent No.: US 6,626,371 B1
(45) Date of Patent: Sep. 30, 2003

(54) COMMON RAIL INJECTOR

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 116 days.

(21) Appl. No.: 09/806,690

(22) PCT Filed: Aug. 1, 2000

(86) PCT No.: PCT/DE00/02532

§ 371 (c)(1),
(2), (4) Date: Jul. 27, 2001

(87) PCT Pub. No.: WO01/11220

PCT Pub. Date: Feb. 15, 2001

Related U.S. Application Data

(63) Continuation-in-part of application No. 09/319,533, filed on Jul. 21, 1999, now Pat. No. 6,247,452.

(30) Foreign Application Priority Data

Oct. 9, 1997 (DE) ..... 197 44 518
Aug. 4, 1999 (DE) ..... 199 36 669

(51) Int. Cl.[7] ..... F02M 41/16; F02M 47/02; F02M 59/00; B05B 1/30

(52) U.S. Cl. ..... 239/96; 239/91; 239/533.2; 239/533.3; 239/585.5

(58) Field of Search ..... 239/88–91, 92, 239/93–96, 533.3, 533.2, 533.9, 585.1, 585.3, 585.4, 585.5, 124, 127; 251/129.15, 129.21, 127

(56) References Cited

U.S. PATENT DOCUMENTS

| | | | | | |
|---|---|---|---|---|---|
| 4,605,166 | A | * | 8/1986 | Kelly | 239/96 |
| 4,807,811 | A | * | 2/1989 | Aketa et al. | 239/91 |
| 5,413,076 | A | * | 5/1995 | Koenigswieser et al. | 123/446 |
| 5,441,029 | A | * | 8/1995 | Hlousek | 123/467 |
| 5,472,142 | A | * | 12/1995 | Iwanaga | 239/96 |
| 5,671,715 | A | * | 9/1997 | Tsuzaki | 123/467 |
| 5,873,526 | A | * | 2/1999 | Cooke | 239/88 |

FOREIGN PATENT DOCUMENTS

| | | |
|---|---|---|
| DE | 1 97 44 518 A1 | 4/1999 |
| DE | 1 99 54 023 A1 | 5/2000 |

* cited by examiner

*Primary Examiner*—Davis Hwu
(74) *Attorney, Agent, or Firm*—Ronald E. Greigg

(57) ABSTRACT

The invention relates to a common rail fuel injector having an injector housing with a fuel inlet in communication with a central high-pressure fuel reservoir outside the injector housing and with a pressure chamber inside the injector housing. A control valve that assures that a nozzle needle lifts from a seat when the pressure in the pressure chamber is greater than the pressure in a control chamber that communicates with the fuel inlet via an inlet throttle and with a relief chamber via a fuel outlet. The control chamber is integrated with the end, remote from the combustion chamber, of the nozzle needle.

20 Claims, 2 Drawing Sheets

COMMON RAIL INJECTOR

This application is a 35 USC 371 application of PCT/DE 00/02532 filed on Aug. 1, 2000 and a continuation-in-part application of application Ser. No. 09/319,533, filed Jul. 21,1999 now U.S. Pat. No. 6,247,452.

FIELD OF THE INVENTION

The invention relates to a common rail injector for injecting fuel in a common rail injection system of an internal combustion engine, which system has an injector housing with a fuel inlet that is in communication with a central high-pressure fuel reservoir outside the injector housing and with a pressure chamber inside the injector housing, from which fuel subjected to high pressure is injected as a function of the position of a control valve that assures that a nozzle needle movable back and forth and received in a longitudinal bore of the injector axially counter to the prestressing force of a nozzle spring that is received in a nozzle spring chamber, lifts from a seat when the pressure in the pressure chamber is greater than the pressure in a control chamber that communicates with the fuel inlet via an inlet throttle and with a relief chamber via a fuel outlet.

DESCRIPTION OF THE PRIOR ART

In common rail injection systems, a high-pressure pump pumps the fuel into the central high-pressure fuel reservoir, which is called a common rail. From the high-pressure fuel reservoir, high-pressure lines lead to the individual injectors, which are assigned to the engine cylinders. The injectors are triggered individually by the engine electronics. The rail pressure prevails in the pressure chamber and at the control valve. When the control valve opens, fuel subjected to high pressure reaches the combustion chamber, past the nozzle needle that is lifted counter to the prestressing force of the nozzle spring.

In conventional injectors, of the kind known for instance from German Patent Disclosure DE 197 24 637 A1, relatively long nozzle needles are used. In operation, because of the high pressures and the rapid load changes, very strong forces act on the nozzle needle. These forces cause the nozzle needle to be stretched and compressed in the longitudinal direction. This in turn means that the nozzle needle stroke varies as a function of the forces acting on the nozzle needle.

The object of the invention is to furnish a common rail injection system with a small structural volume that is simple in design and can be produced economically. In particular, even at a high nozzle needle speed, good closing performance should be assured.

In a common rail injector for injecting fuel in a common rail injection system of an internal combustion engine, which system has an injector housing with a fuel inlet that is in communication with a central high-pressure fuel reservoir outside the injector housing and with a pressure chamber inside the injector housing, from which fuel subjected to high pressure is injected as a function of the position of a control valve that assures that a nozzle needle movable back and forth and received in a longitudinal bore of the injector axially counter to the prestressing force of a nozzle spring that is received in a nozzle spring chamber, lifts from a seat when the pressure in the pressure chamber is greater than the pressure in a control chamber that communicates with the fuel inlet via an inlet throttle and with a relief chamber via a fuel outlet, this object is attained in that the control chamber is integrated with the end of the nozzle needle remote from the combustion chamber. This furnishes a compact common rail injector which assures rapid closure of the nozzle needle. The control chamber can be made smaller than in conventional injectors, which makes for a rapid response performance by the injector. Embodying the injector according to the invention makes rail pressures of up to 1800 bar possible.

One particular type of embodiment of the invention is characterized in that in the end, remote from the combustion chamber, of the nozzle needle a substantially cylindrical recess is provided, in which an outer circumferential portion of a bush is axially displaceably received with a sealing effect, the end face, remote from the combustion chamber, of which bush is pressed by the prestressing force of the nozzle spring against the injector housing, and the interior of which bush communicates with the fuel outlet. The bush offers the advantage that the control chamber and the nozzle spring chamber can be combined on the end, remote from the combustion chamber, of the nozzle needle without the volume of the control chamber being dependent on the installation space for the nozzle spring. It is therefore possible to build in a nozzle spring with a high spring stiffness, which assures good closure of the nozzle needle. As a result, the duration and instant of injection can be defined exactly.

A further particular type of embodiment of the invention is characterized in that on the end of the bush remote from the combustion chamber, a collar is embodied, which forms an abutment for the nozzle spring that is prestressed counter to the end, remote from the combustion chamber, of the nozzle needle. In the context of the present invention, the nozzle spring has a dual function. First, the closing motion of the nozzle needle is effected by the prestressing force of the nozzle spring, and second, the control chamber volume is defined by the prestressing force of the nozzle spring in conjunction with the pressure in the control chamber.

Another particular type of embodiment of the invention is characterized in that on the face end of the bush remote from the combustion chamber, which is in contact with the injector housing, a biting edge is embodied. As a result, the control chamber is separated from the nozzle spring chamber surrounding the bush.

Another particular type of embodiment of the invention is characterized in that the fuel inlet communicates with the pressure chamber via the nozzle spring chamber, and that the nozzle needle is guided between the nozzle spring chamber and the pressure chamber. This offers the advantage that the nozzle needle guide no longer has any sealing function. This makes the demands in terms of quality of the guide less stringent, leading to economies in production. Since the same pressure prevails on both sides of the guide, guide leakage no longer occurs.

A further particular type of embodiment of the invention is characterized in that at least one flat face, past which fuel from the nozzle spring chamber can reach the pressure chamber, is embodied on the nozzle needle between the nozzle spring chamber and the pressure chamber. This type of embodiment offers advantages especially with regard to the high-pressure strength.

Another particular type of embodiment of the invention is characterized in that the inlet throttle is integrated with the nozzle needle or the bush. The inlet throttle serves to prevent pressure surges in operation.

A further particular type of embodiment of the invention is characterized in that the nozzle needle stroke is defined by the spacing between the nozzle needle and the bush. This purely mechanical nozzle needle stroke end stop offers the advantage that the nozzle needle stroke is exactly replicable. As a result, the course of injection can be shaped reliably. So-called hydraulic sticking is avoided.

A further particular type of embodiment of the invention is characterized in that on the end of the bush remote from the combustion chamber, an auxiliary control chamber is embodied, which communicates via an inlet throttle with the nozzle spring chamber and via an auxiliary throttle with the cylindrical recess in the nozzle needle. In this type of embodiment, during the closing motion of the nozzle needle, the bush can be lifted from its seat on the injector housing. As a result, the auxiliary control chamber and the cylindrical recess that forms the actual control chamber can be more quickly filled with fuel that is at high pressure. This further speeds up the closing motion of the nozzle needle.

BRIEF DESCRIPTION OF THE DRAWINGS

Further advantages, characteristics and details of the invention will become apparent from the ensuing description, in which various exemplary embodiments of the invention are described in detail in conjunction with the drawings, in which.

DESCRIPTION OF THE PREFERRED EMBODIMENTS

Figure 1:
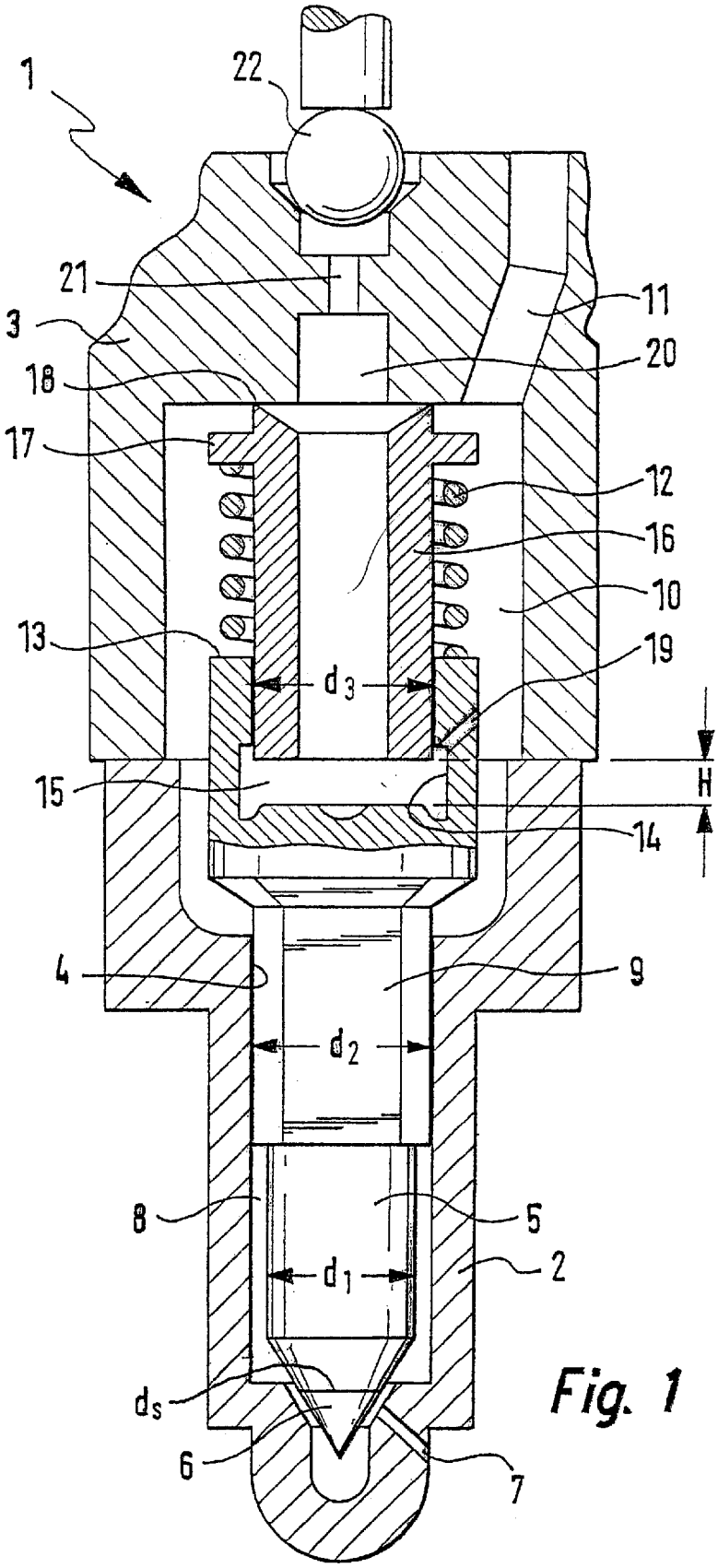
FIG. 1 is a first exemplary embodiment of an injector of the invention, in a longitudinal section through the injector housing.

The first exemplary embodiment, shown in longitudinal section in FIG. 1, of the injector of the invention has an injector housing identified overall by reference numeral 1. The injector housing 1 includes a nozzle body 2, which with its free end protrudes into the combustion chamber of the internal combustion engine to be supplied. With its end face remote from the combustion chamber, the nozzle body 2 is braced axially against a retaining body 3 by means of a lock nut (not shown).

An axial guide bore 4 is recessed out of the nozzle body 2. A nozzle needle 5 with a tip 6 is guided axially displaceably in the guide 4. A sealing face is embodied on the tip 6 of the nozzle needle 5 and cooperates with a sealing seat that is embodied on the nozzle body 2. The diameter of the sealing seat is indicated by $d_s$. If the tip 6 of the nozzle needle 5 is located with its sealing face in contact with the sealing seat, an injection port 7 in the nozzle body 2 is closed. When the nozzle needle tip 6 lifts from its seat, fuel subjected to high pressure is injected through the injection port 7 into the combustion chamber of the engine. The stroke of the nozzle needle 5 is indicated by the letter H.

The nozzle needle 5 has three regions of different diameters $d_1$, $d_2$ and $d_3$, beginning at the tip 6. The diameter $d_1$ is somewhat smaller than the diameter $d_2$. Because of the difference in diameter between $d_2$ and $d_1$, an annular chamber 8 is created in the vicinity of the end of the nozzle body 2, toward the combustion chamber or tip 6. The annular chamber 8 is also called a pressure chamber. The diameter $d_2$ of the nozzle needle 5, in the present example, is equivalent to the diameter $d_3$ at the nozzle needle 5. The diameter $d_2$ is also called the guide diameter. The diameter $d_3$ is also called the control diameter. In the present exemplary embodiment, the outside diameter $d_2$ of the nozzle needle 5 is equal to the inside diameter $d_3$ of the recess 14 in the end of the nozzle needle 5 remote from the combustion chamber or tip 6. However, the diameter $d_3$ may also be smaller than the diameter $d_2$.

In the guide portion of the nozzle needle 5 having the diameter $d_2$, there is at least one flat face 9. The flat face 9 creates a communication between a nozzle spring chamber 10 and the pressure chamber 8. The nozzle spring chamber 10 is surrounded by the nozzle body 2 and the retaining body 3. A fuel inlet 11 is disposed in the retaining body 3 and discharges into the nozzle spring chamber 10. A nozzle spring 12 is disposed in the nozzle spring chamber 10. The nozzle spring 12 is braced on the end face of the nozzle needle 5 remote from the combustion chamber or tip 6. A cylindrical recess 14, which surrounds a control chamber 15, is located in the center of the end face of the nozzle needle 5 remote from the combustion chamber or tip 6. A bush 16 is guided on its outer jacket face in the region of the cylindrical recess 14 having the diameter $d_3$. On the end of the bush 16 remote from the combustion chamber or tip 6, there is a collar 17, which forms an abutment for the prestressed nozzle spring 12. A biting edge 18, which is in contact with the retaining body 3, is also embodied on the end face of the bush 16 remote from the combustion chamber of the engine or the tip 6 of the nozzle needle.

The control chamber 15 communicates with the nozzle spring chamber 10 via an inlet throttle 19. The control chamber 15 also communicates via the interior of the bush 16 with a fuel outlet 20. An outflow throttle 21 is located in the fuel inlet 20. The fuel inlet 20 is closed by a control valve member 22. If the control valve member 22 lifts from its seat, the fuel outlet 20 is connected to a pressure relief chamber (not shown).

The common rail injector shown in FIG. 1 functions as follows: Via the fuel inlet 11, fuel subjected to high pressure flows out of the rail into the nozzle spring chamber 10. From there, the fuel at high pressure on the one hand reaches the control chamber 15 via the inlet throttle 19 and on the other flows past the flat face 9 to reach the pressure chamber 8. The diameter ratios are selected in a known manner such that the nozzle needle 5, as a result of the high pressure in the control chamber 15, is located with its tip 6 in contact with the nozzle needle seat. When the control valve member 22 opens, the control chamber 15 is relieved, and the nozzle needle tip 6 lifts from its seat. Then, fuel subjected to high pressure is injected through the injection port 7 into the combustion chamber of the engine until such time as the control valve member 22 closes again. The consequence is then that the pressure in the control chamber 15 rises, and because of the prestressing force of the nozzle spring 12, the nozzle needle 5 is pressed with its tip 6 back against the associated nozzle needle seat.

Figure 2:
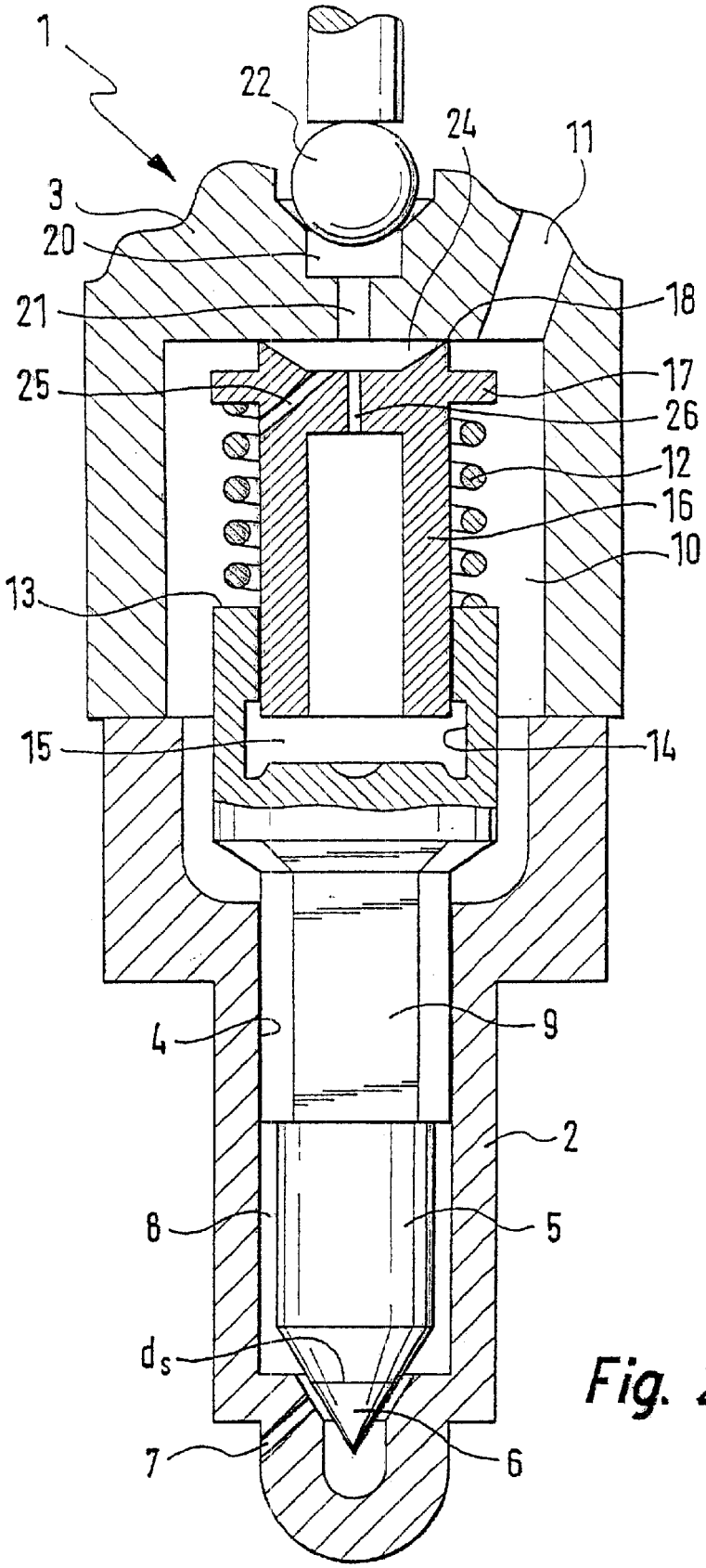
FIG. 2 is a second exemplary embodiment of an injector of the invention, in a longitudinal section through the injector housing.

The second exemplary embodiment, shown in FIG. 2, is largely equivalent to the first exemplary embodiment shown in FIG. 1. For the sake of simplicity, the same reference numerals are used to designate the same elements. Also in order to avoid repetition, reference is made to the above description of the first exemplary embodiment. Below, only the differences between the two exemplary embodiments will be addressed.

In the second exemplary embodiment shown in FIG. 2, an auxiliary control chamber 24 is embodied on the end of the bush 16 remote from the combustion chamber. The auxiliary control chamber 24 communicates with the nozzle spring chamber 10 via an inlet throttle 25. The auxiliary control chamber 24 also communicates with the control chamber 15, via an auxiliary throttle 26. In the exemplary embodiment shown in FIG. 2, the bush 16 can lift from its seat on the retaining body 3 in the closing motion of the nozzle needle 5. The lifting of the bush 16 from its seat is assured by the auxiliary throttle 26. When the control valve member 22 closes, the auxiliary control chamber 24 first fills with fuel subjected to high pressure, and only after that does the control chamber 15 fill with such fuel.

The control valve member 22 is shown merely by way of example. Within the scope of the present invention, force-balanced magnet valves or double-switching piezoelectric actuators could be used equally well.

The foregoing relates to preferred exemplary embodiments of the invention, it being understood that other variants and embodiments thereof are possible, within the spirit and scope of the invention, the latter being defined by the appended claims.

I claim:

1. In a common rail injector for injecting fuel in a common rail injection system of an internal combustion engine, which system has an injector housing (1) with a fuel inlet (11) that is in communication with a central high-pressure fuel reservoir outside the injector housing (1) and with a pressure chamber inside the injector housing (1), from which fuel subjected to high pressure is injected as a function of the position of a control valve (22) that assures that a nozzle needle (5) movable back and forth and received in a longitudinal bore (4) of the injector axially counter to the prestressing force of a nozzle spring (12) that is received in a nozzle spring chamber (10), lifts a tip (6) of the nozzle needle from a seat when the pressure in the pressure chamber (8) is greater than the pressure in a control chamber (15) that communicates with the fuel inlet via an inlet throttle (19; 25, 26) and with a relief chamber via a fuel outlet (20), the improvement wherein the control chamber (15) is formed, in part, by a substantially cylindrical recess (14) in an end of the nozzle needle (5), remote from the tip (6).

2. The common rail injector of claim 1, wherein an outer circumferential portion of a bush (16) is axially displaceably received with a sealing effect in said substantially cylindrical recess (14), an end face, remote from tip (6), of which bush is pressed by the prestressing force of the nozzle spring (12) against the injector housing (1), and an interior of which bush communicates with the fuel outlet (20).

3. The common rail injector of claim 2, wherein on the end (16) of the bush, remote from the tip (6), a collar (17) is embodied, which forms an abutment for the nozzle spring (12) that is prestressed counter to the end of the nozzle needle (5) remote from the tip (6).

4. The common rail injector of claim 3, wherein on the face end of the bush (16), remote from the tip (6), which is in contact with the injector housing (1), a biting edge (18) is embodied.

5. The common rail injector of claim 4, wherein the fuel inlet (11) communicates with the pressure chamber (8) via the nozzle spring chamber (10), and that the nozzle needle (5) is guided between the nozzle spring chamber (10) and the pressure chamber (8).

6. The common rail injector of claim 5, wherein at least one flat face (9), past which fuel can flow from the nozzle spring chamber (10) into the pressure chamber (8), is embodied on the nozzle needle (5) between the nozzle spring chamber (10) and the pressure chamber (8).

7. The common rail injector of claim 3, wherein the fuel inlet (11) communicates with the pressure chamber (8) via the nozzle spring chamber (10), and that the nozzle needle (5) is guided between the nozzle spring chamber (10) and the pressure chamber (8).

8. The common rail injector of claim 7, wherein at least one flat face (9), past which fuel can flow from the nozzle spring chamber (10) into the pressure chamber (8), is embodied on the nozzle needle (5) between the nozzle spring chamber (10) and the pressure chamber (8).

9. The common rail injector of claim 3, wherein the inlet throttle (19; 25) is integrated with the nozzle needle (5) or with the bush (16).

10. The common rail injector of claim 3, wherein the nozzle needle stroke (H) is defined by the axial spacing between the nozzle needle (5) and the bush (16).

11. The common rail injector of claim 2, wherein on the face end of the bush (16), remote from the tip (6), which is in contact with the injector housing (1), a biting edge (18) is embodied.

12. The common rail injector of claim 11, wherein the fuel inlet (11) communicates with the pressure chamber (8) via the nozzle spring chamber (10), and that the nozzle needle (5) is guided between the nozzle spring chamber (10) and the pressure chamber (8).

13. The common rail injector of claim 12, wherein at least one flat face (9), past which fuel can flow from the nozzle spring chamber (10) into the pressure chamber (8), is embodied on the nozzle needle (5) between the nozzle spring chamber (10) and the pressure chamber (8).

14. The common rail injector of claim 2, wherein the inlet throttle (19; 25) is integrated with the nozzle needle (5) or with the bush (16).

15. The common rail injector of claim 2, wherein the nozzle needle stroke (H) is defined by the axial spacing between the nozzle needle (5) and the bush (16).

16. The common rail injector of claim 2, wherein on the end of the bush (16), remote from the tip (6), an auxiliary control chamber (24) is embodied, which communicates via an inlet throttle (25) with the nozzle spring chamber (10) and via an auxiliary throttle (26) with the cylindrical recess (14) in the nozzle needle (5).

17. The common rail injector of claim 2, wherein the fuel inlet (11) communicates with the pressure chamber (8) via the nozzle spring chamber (10), and that the nozzle needle (5) is guided between the nozzle spring chamber (10) and the pressure chamber (8).

18. The common rail injector of claim 17, wherein at least one flat face (9), past which fuel can flow from the nozzle spring chamber (10) into the pressure chamber (8), is embodied on the nozzle needle (5) between the nozzle spring chamber (10) and the pressure chamber (8).

19. The common rail injector of claim 1, wherein the fuel inlet (11) communicates with the pressure chamber (8) via the nozzle spring chamber (10), and that the nozzle needle (5) is guided between the nozzle spring chamber (10) and the pressure chamber (8).

20. The common rail injector of claim 19, wherein at least one flat face (9), past which fuel can flow from the nozzle spring chamber (10) into the pressure chamber (8), is embodied on the nozzle needle (5) between the nozzle spring chamber (10) and the pressure chamber (8).

* * * * *